United States Patent [19]

Ahs

[11] Patent Number: 4,630,865

[45] Date of Patent: Dec. 23, 1986

[54] BACKREST ADJUSTING DEVICE

[75] Inventor: Wilgot Åhs, Koppom, Sweden

[73] Assignee: Erress, Hagfors, Sweden

[21] Appl. No.: 554,766

[22] Filed: Nov. 23, 1983

[30] Foreign Application Priority Data

Nov. 24, 1982 [SE] Sweden ..... 8206689

[51] Int. Cl.[4] ..... A47C 3/00; A47C 7/02

[52] U.S. Cl. ..... 297/284; 297/452

[58] Field of Search ..... 297/452, 391, 284, 460, 297/DIG. 3; 267/170, 71.1, 64.11; 296/66

[56] References Cited

U.S. PATENT DOCUMENTS

| | | | |
|---|---|---|---|
| 660,132 | 10/1900 | Walker | 297/452 |
| 2,564,621 | 8/1951 | Emberson | 297/460 |
| 3,231,008 | 1/1966 | Seckel | 297/452 X |
| 3,680,912 | 8/1972 | Matsuura | 297/391 |
| 4,019,777 | 4/1977 | Hayashi | 297/284 |
| 4,108,492 | 8/1978 | Kirby | 297/DIG. 3 |
| 4,148,522 | 4/1979 | Sakurada et al. | 297/284 |
| 4,155,592 | 5/1979 | Tsudu et al. | 297/284 |
| 4,431,229 | 2/1984 | Unger | 297/452 X |
| 4,452,485 | 6/1984 | Schuster | 297/460 X |
| 4,467,484 | 8/1984 | Nagatake et al. | 297/DIG. 3 |

FOREIGN PATENT DOCUMENTS

| | | | |
|---|---|---|---|
| 2117235 | 10/1983 | United Kingdom | 297/460 |

*Primary Examiner*—William E. Lyddane
*Assistant Examiner*—José V. Chen
*Attorney, Agent, or Firm*—Burns, Doane, Swecker & Mathis

[57] ABSTRACT

The invention relates to a device for adjusting the backrest, preferably of vehicle seats. It is characterized by a first plate-shaped portion, which by a belt-like member is connected to a rigid part of one lateral edge of the seat back, and a second plate-shaped portion, which by a belt-like member is connected to a rigid part of the second lateral edge of the seat back. The plate-shaped portions are located with their plane sides facing to each other, and a spring means is provided to stretch the belt-like members between the lateral edges. A holder-on member is located outside the plate-shaped portions and receives a means intended as desired to press the plate-shaped portions into locking engagement with each other and, respectively, with the holder-on member.

14 Claims, 5 Drawing Figures

BACKREST ADJUSTING DEVICE

BACKGROUND OF THE INVENTION

This invention relates to a device for adjusting the backrest, particularly the lumbar support, of seats. The device preferably is intended for use with vehicle seats where, due to alternating g-forces in combination with periods of long duration of occupying the seat, an anatomically correct support for the back is desirable to prevent lingering back injuries.

It is previously known to provide vehicle seats with lumbar supports, which may consist of one or more belts located on the same level as the lumbar region of the back. These belts are adjustable in their stretching transversely to the seat back. the stretching in principle is effected by a screw-nut device. Another type of adjustable lumbar support comprises one or more inflatable cushions provided in the backrest. The pressure in the cushions is adjusted by one or more small hand pumps. In the first-mentioned type of lumbar support, the belts are loosened or stretched by the screw-nut device. In the second type of lumbar support, an amount of air is pumped into or discharged from the cushions to bring about a correct sitting position. Both types of lumbar supports thus require a relatively complicated adjusting process, which in turn implies that the user often carries out the adjusting in a negligent or careless manner and thereby fails to produce the effect desired of the relatively expensive seat.

The present invention yields a backrest adjusting device which per se is simple and renders its adjusting very simple, thereby increasing the efficiency of the seat.

The invention is described in greater detail in the following description when read in conjunction with the accompanying drawings.

Brief Description of the Drawings

In FIG. 1, the numeral 1 designates a schematically shown vehicle seat, the back of which includes of a tubular steel frame with two substantially vertical edge tubes 2. The seat back includes an adjusting device according to the invention for adjusting the backrest or lumbar support in the form of three belts 3 laid about the respective edge tubes 2. The belts are in principle arranged loosely about the edge tubes, but are prevented from being displaced in a vertical direction by shoulders or sleeves of suitable configuration (not shown).

Figure 1:
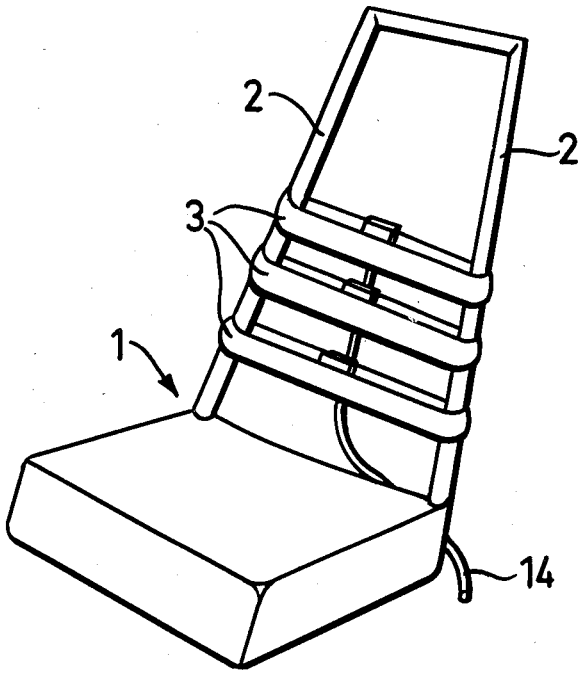
FIG. 1 is a schematic illustration of the device according to the invention positioned on a seat.

Each belt has at each free end plate-shaped portions 4,5, respectively, which are either directly an integral part of the belt material or may be made of a suitable material and attached to the belt ends. As appears from FIG. 2, the respective belt is laid about the tube edges 2 so as to overlap with their plate-shaped portions 4 and 5, so that their plane sides face toward each other. Each plate-shaped portion 4,5 is provided at its end facing to the belt with a stud or hold 6, between which a tension spring 7 extends which, as is easily understood, tends to permanently maintain the belt 3 stretched between the edges 2 of the seat back.

Figure 2:
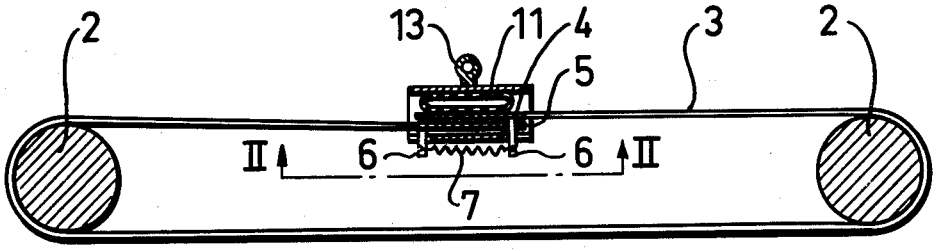
FIG. 2 is a schematic sectional view of one embodiment of the device according to the invention.
Figure 3:
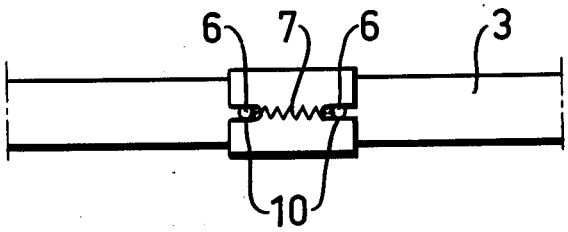
FIG. 3 shows the device according to FIG. 2 seen in the direction of the arrows II—II.
Figure 4:
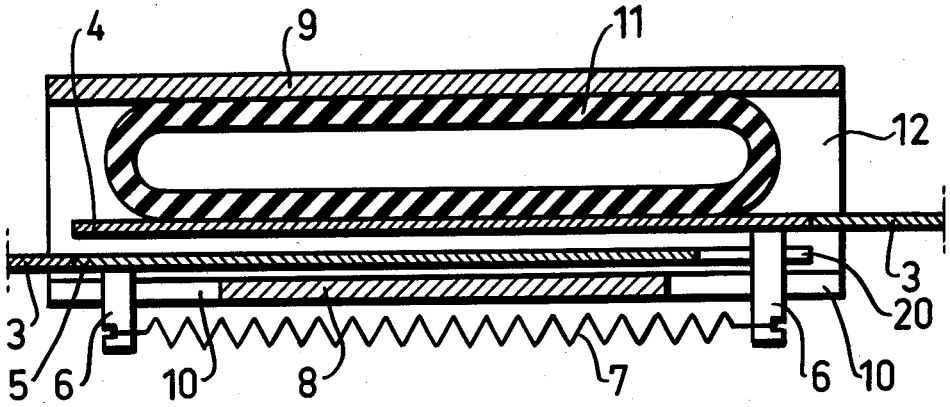
FIG. 4 is an enlarged view of a section of the device according to FIGS. 2 and 3.

As shown in FIGS. 2–4, on each side of the plate-shaped portions 4,5 of the belts is a plane holder-on or supporting member 8,9. These holder-on or supporting members preferably form two opposed sides of a cross-sectionally rectangular sleeve. The side 8 of the sleeve is provided with recesses 10, through which the studs 6 extend and which render it possible for the studs, and thereby for the plate-shaped portions, to move relative to the holder-on or supporting member 8. Located between the plate-shaped portion 4 and the holder-on or supporting member 9 is a bubble or bladder 11, for example of rubber, which, as shown in FIGS. 2 and 4, is entirely housed in a case between the long sides 12 of the cross-sectionally rectangular sleeve. The rubber bubble or bladder 11 is provided with one common inlet and outlet 13 as schematically indicated in FIG. 2.

The mode of operation of the device according to the invention should be understood easily from the above description. A person occupies the seat and assumes a sitting position comfortable for the back. The belts 3 in the backrest will have adjusted their length to this position by means of the spring 7. The person now opens a valve, which supplies compressed air from the normal pneumatic system of the vehicle via a hose 14 to the rubber bubbles or bladders of the three belts 3 indicated in the Figures, which bubbles or bladders in this case are connected in parallel with the hose 14. The rubber bubble or bladder 11 for the respective belt is thereby pressurized and presses the plate-shaped portions 4 and 5 between itself and the holder-on or supporting member 8. Friction between the holder-on or supporting member 8 and plate-shaped portions 5 and 4, respectively, locks the belt 3 at its assumed length. As long as the rubber bubbles or bladders are subjected to the effect of pressure, the length of the belts is locked, and the position of rest selected for the back is fixed. As soon as the pressure in the rubber bubbles or bladders is eliminated, it is possible to choose another support configuration for the back. The invention thus renders it very simple, for example, upon an exchange of drivers, for the new driver to rapidly adjust the seat back to his or her own driving position.

Figure 5:
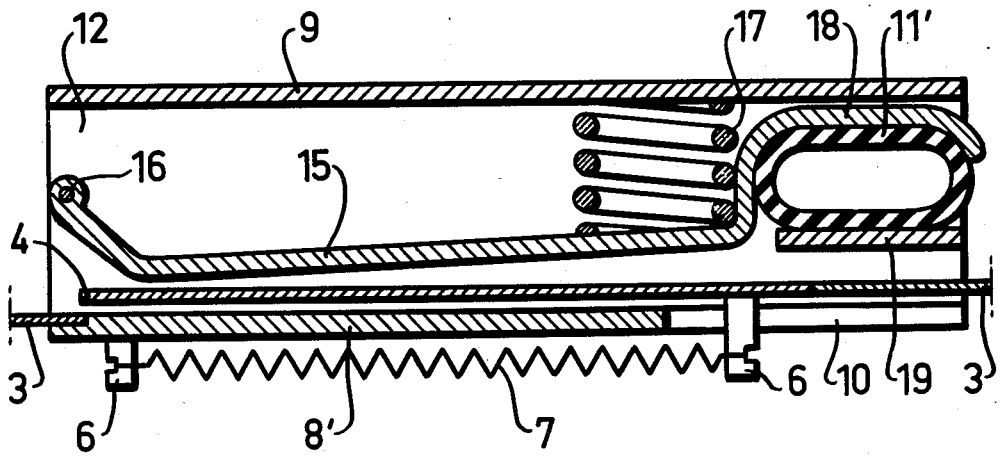
FIG. 5 is a schematic sectional view of a second embodiment of the device.

In FIG. 5 a slightly modified embodiment of the invention is shown. The afore-mentioned holder-on or supporting member 8 is designed as an integral part of one plate-shaped portion of the belt and forms a holder-on or supporting member 8'. It is, of course, possible also to provide the device showin in FIG. 4 with this type of holder-on or supporting member. Located between the free plate-shaped portion 4 and the holder-on or supporting member 9 is a pressing plate 15 pivotably mounted about an axle 16 extending in a plane parallel with the belt 3, but transversely thereto. Located between the holder-on or supporting member 9 and pressing plate 15 is a compression spring 17. The spring 17 is supported by the holder-on or supporting member 9 and presses the pressing plate 15 against the plate-shaped portion 4 and holder-on or supporting member 8', which are thereby locked against each other by friction. The pressing plate 15 has at its free end a seat 18. Positioned between this seat and a cross bar 19 extending between the long sides 12 of the cross-sectionally rectangular sleeve is a bubble or bladder 11'. This bubble or bladder 11', n a way similar to that described with reference to the rubber bubble or bladder 11, is provided with one common inlet and outlet, which in a suitable way is connected to the pneumatic system of the vehicle.

The device operates in a way corresponding to that of the device described with reference to FIGS. 2–4, with the difference, however, that the length of the belts 3 is fixed as soon as the pressure in the bubbles or bladders 11' has been eliminated. When, for example, the driver is to adjust the support surface of the seat back, the afore-mentioned valve is opened and pressurized air is supplied to the bubbles or bladders. The bubbles or bladders then lift the pressing plates 15 and the plate-shaped portions of the respective belt can move relative to each other. When the correct sitting position has been assumed, the air is released from the rubber bubbles or bladders 11, and the springs 17 by means of the pressing plates 15 lock the belts at their respective assumed lengths.

As shown in FIGS. 2 and 4, depending on the attachment of the stud 6 in the plate-shaped portion 4, the free end of the adjacent plate-shaped portion 5 is provided with a recess or indent 20 to permit relative movement between the two portions 4 and 5. The length of the recesses 10 and 20 is to be adapted to the movement which the plate-shaped portions are permitted to make relative to each other. The belts can consist of two parts, each fastened only with one strand on one edge of the frame of the seat back. In order in this case to obtain a shape as flat as possible for the locking device, the tension spring 7 can be replaced by tension springs located on each long side of the sleeve 9,8,12. The seat back is lined in a suitable way (not shown) with padding or foamed plastic. The plate-shaped portions 4,5,8' can be provided with any conventional friction-increasing surface coating. The rubber bubbles or bladders 11, 11', of course, can be replaced by a bubble or bladder of a material other than rubber, or by another member expanding under pressure, including even a mechanically expanding member. The pressure medium, of course, need not be air or gas, but also may be a liquid. Alternatively to the embodiments shown, the bubble or bladder 11 may be located, for example, between the two plate-shaped portions 4,5, thereby pressing the portion 4 against the holder-on or supporting member 9, and the portion 5 against the holder-on or supporting member 8.

Although the invention has been described in connection with preferred embodiments, it is understood that variations and modifications may be resorted to as will be apparent to those skilled in the art. Such variations and modifications are to be considered within the purview and scope of the claims appended hereto.

What I claim is:

1. A device for adjusting the backrest of a seat, comprising:

first and second plates movable relative to one another, said first plate being connected by an adjustable belt to a rigid part of a first lateral edge of a seat back, said second plate being connected by the adjustable belt to a rigid part of a second lateral edge of the seat back, said first and second plates being oriented such that a side of the first plate substantially faces a side of the second plate;

spring means for adjusting the length of the adjustable belt between the lateral edges of the seat back;

a supporting member located outside of a space defined between said first and second plates for receiving means for pressing said plates into locking engagement with one another and with the supporting member.

2. A device as defined in claim 1, wherein said means for pressing said plates is a bubble connected to a pressure source, said plates being located between the bubble and the supporting member.

3. A device as defined in claim 1, wherein said means for pressing said plates is a compression spring acting against a pressing plate, at least one of said first and second plates being located between the pressing plate and the supporting member, a bubble being connected to said pressure source for lifting the pressing plate from the first and second plates and the supporting member.

4. A device as defined in claim 1, wherein one of said first and second plates is located at each end of said adjustable member the plates being positioned about a rigid part of the lateral edge.

5. A device as defined in claim 1 wherein each of said first and second plates is located on one adjustable member, a free end of each plate being attached to opposed rigid parts of the lateral edges.

6. A device as defined in claim 1, wherein the supporting member comprises at least one plane portion and an opposed portion fixed relative to the plane portion.

7. A device as defined in claim 6, wherein said supporting member has the configuration of a sleeve rectangular in cross-section, the sides of which sleeve being located outside the lateral edges of the adjustable belts connecting the plane portion with the opposed portion of said supporting member.

8. A device as defined in claim 7, wherein a bubble is located between the opposed portion of said supporting member and one of said plates.

9. A device as defined in claim 6, wherein the pressing plate is mounted pivotally between the sides of said sleeve, a bubble being located between a free end of the pressing plate and a member rigid relative to the sleeve, one end of said compression spring engaging said opposed portion of said supporting member and another end of said spring engaging said pressing plate.

10. A device as defined in claim 6, wherein said means for pressing said plates is a bubble connected to a pressure source, said plates being located between the bubble and the supporting member.

11. A device as defined in claim 6, wherein said means for pressing said plates is a compression spring acting against a pressing plate, at least one of said first and second plates being located between the pressing plate and the supporting member, a bubble being connected to said pressure source for lifting the pressing plate from the first and second plates and the supporting member.

12. A device as defined in claim 6, wherein the plane portion is integral with one of the plates.

13. A device as defined in claim 12, wherein said means for pressing said plates is a bubble connected to a pressure source, said plates being located between the bubble and the supporting member.

14. A device as defined in claim 12, wherein said means for pressing said plates is a compression spring acting against a pressing plate, at least one of said first and second plates being located between the pressing plate and the supporting member, a bubble being connected to said pressure source for lifting the pressing plate from the first and second plates and the supporting member.

* * * * *